United States Patent [19]

Dorey et al.

[11] Patent Number: 4,513,264

[45] Date of Patent: Apr. 23, 1985

[54] BANDPASS FILTER WITH PLURALITY OF WAVE-GUIDE CAVITIES

[75] Inventors: James B. Dorey; Wai-Cheung Tang, both of Kitchener, Canada

[73] Assignee: Com Dev Ltd., Cambridge, Canada

[21] Appl. No.: 448,969

[22] Filed: Dec. 13, 1982

[30] Foreign Application Priority Data

Aug. 25, 1982 [CA] Canada ..... 410124

[51] Int. Cl.[3] ..... H01P 1/16; H01P 1/208

[52] U.S. Cl. ..... 333/212; 333/209; 333/230

[58] Field of Search ..... 333/202, 206–212, 333/232–235, 245, 248, 227–231

[56] References Cited

FOREIGN PATENT DOCUMENTS 799163 8/1958 United Kingdom ..... 333/212

*Primary Examiner*—Marvin L. Nussbaum

*Attorney, Agent, or Firm*—Daryl W. Schnurr

[57] ABSTRACT

A bandpass filter 8 has a plurality of cascaded waveguide cavities 11, 12 1N and inter-cavity coupling means 36, 37. One or more of the cavities 12, 1N is rotated relative to an input reference mode 52. The rotation causes quasi-orthogonal coupling structures to be introduced into said cavities 11, 12 1N. The rotation of one or more cavities enables symmetric or asymmetric amplitude and phase responses to be produced as desired.

The filter can be used in channel multiplexers for satellite communication systems.

12 Claims, 13 Drawing Figures

PRIOR ART

PRIOR ART

PRIOR ART

BANDPASS FILTER WITH PLURALITY OF WAVE-GUIDE CAVITIES

BACKGROUND OF THE INVENTION

1. Field of the Invention

This invention relates to a bandpass filter having a plurality of cascaded wave-guide cavities. In particular, this invention relates to an improvement in dual-mode filters whereby quasi-orthogonal coupling structures are introduced into the cavities.

2. Description of the Prior Art

A dual-mode cylindrical and/or cuboid longitudinal filter structure having input and output ports at opposing ends of the filter is described in U.S. Pat. No. 3,697,898 to Blachier and Champeau. The dual-mode structure allows for two independent orthogonal modes to resonate in a single cavity structure, thus reducing by half the number of physical cavities required in a filter with cavities resonating in a single mode. In addition, the coupling structures in a dual-mode filter allow for positive and/or negative feed back couplings to take place between non-sequential modes. This non-sequential coupling capability can result in an enhancement of the phase characteristics in the passband and/or an enhancement of the amplitude characteristics at the skirts of the filter response.

An improvement to the Blachier and Champeau filter is described in U.S. Pat. No. 4,060,770 to Atia and Williams. The Atia and Williams canonical filter provides the means to realize the most generalized bandpass filter response within the constraints of the synthesis method detailed in an article by Atia, Williams and Newcomb entitled, "Narrow-Band Multiple-Coupled Cavity Synthesis", published in the Institute of Electrical and Electronics Engineers Transactions on Circuits and Systems, Vol. CAS-21, No. 5, September, 1974, at pages 649 to 655. This synthesis method can only be used to design filters which are synchronously tuned and which have symmetrical amplitude and phase frequency response in the dispersionless case. Generally, the Atia and Williams filter has the input and output located in the same cavity rather than at opposite ends of the filter as described by Blachier and Champeau.

An additional filter is described in an article by Pfitzenmaier in the 1977 Institute of Electrical and Electronics Engineers MTT-S International Microwave Symposium Digest, at pages 400 to 403. This filter allows the same generalized bandpass filter response to be realized as the Atia and Williams filter. However, the form of coupling matrix is symmetrical for the Atia and Williams filter and asymmetrical for the Pfitzenmaier filter. Physically, the Atia and Williams filter has the input and output ports in the same dual-mode cavity while the Pfitzenmaier filter has the input and output ports in different dual-mode cavities.

The filters described above generate a geometrically symmetrical amplitude response and an asymmetrical phase response. The asymmetrical characteristic of the phase response is due to wave-guide dispersion and cannot be controlled or compensated by filters described above without destroying the equi-ripple character of the passband response.

It is an object of the present invention to provide a bandpass filter that can produce amplitude and phase responses that are either symmetric or asymmetric, as desired. It is a further object of the present invention to provide a bandpass filter that can be made to produce the most general class of electrical response permissible in a dual-mode structure.

SUMMARY OF THE INVENTION

A bandpass filter has a plurality of cascaded wave-guide cavities with inter-cavity coupling means and an input reference mode. At least one or more of said cavities is rotated with respect to said reference mode, thereby causing quasi-orthogonal coupling structures to be introduced into said cavities. Each cavity has a length equal to n times the half-guide wave length at a centre frequency of the filter, where n is an integer and corresponds to the third mode index of a TE mode micro-wave to be transmitted.

Preferably, the cavities are dual-mode cavities that resonate in a first and second independent orthogonal mode as well as in a first and second quasiorthogonal mode.

BRIEF DESCRIPTION OF THE DRAWINGS

The filters that are previously known as well as embodiments of the present invention are described in the following drawings.

DESCRIPTION OF A PREFERRED EMBODIMENT

Figure 1:
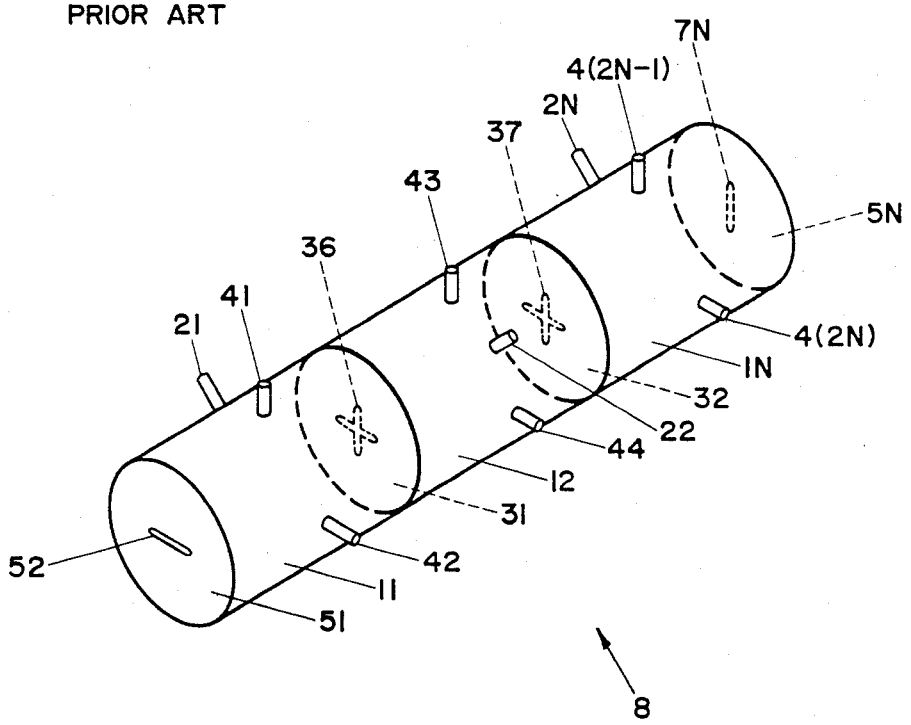
FIG. 1 shows one embodiment of the prior art of Blachier and Champeau, being a dual-mode filter employing cylindrical wave-guide sections and having an input at one end and an output at another end.
Figure 2:
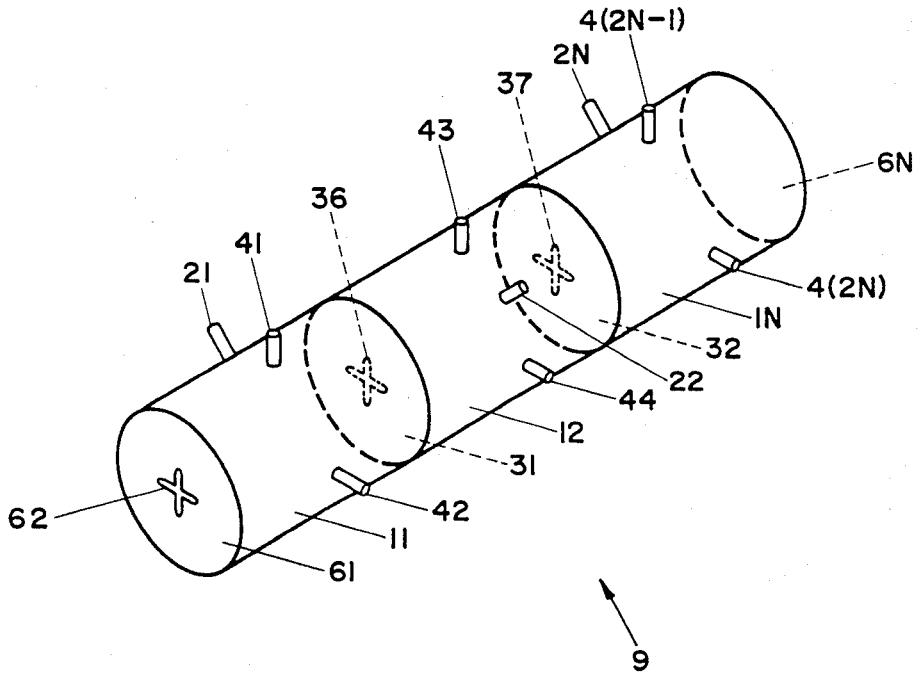
FIG. 2 is an embodiment of the prior art of Atia and Williams, being a dual-mode filter employing cylindrical wave-guide sections and having an input and output in the same cavity.
Figure 3:
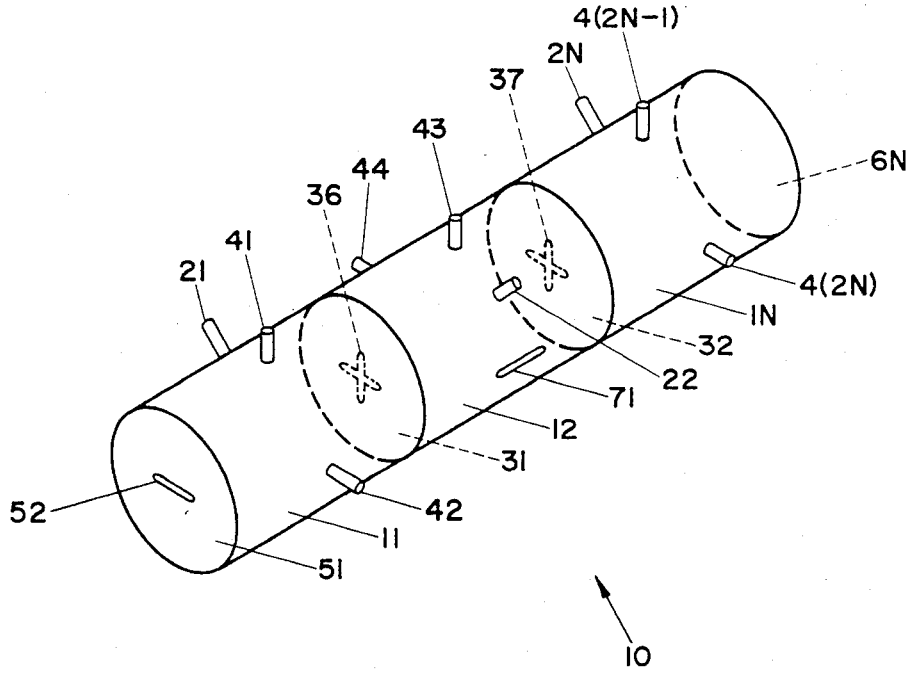
FIG. 3 is an embodiment of the prior art of Pfitzenmaier, being a dual-mode filter employing cylindrical wave-guide sections with an input in one cavity and an output in an adjacent cavity.

FIGS. 1 to 3 describe prior art filters and the remaining figures describe various embodiments derived from modifications made to the prior art filters in accordance with the present invention.

Referring to the drawings in greater detail, in FIG. 1, a dual-mode filter 8, being a prior art Blachier and Champeau filter, has a plurality of cascaded wave-guide cavities 11, 12, . . . 1N which resonate in the TE11n mode. The cavities 11, 12, . . . 1N are shown as cylindrical but could be virtually any suitable elongated shape, for example, cuboid or ellipsoid. If a filter contained cuboid cavities, these would function in the TE10n mode of operation. The cavities 11, 12, 1N are connected end to end with coupling irises, 31, 32 between them to couple electrical energy from one cavity to the next through the filter 8. Said coupling irises 31, 32 are inter-cavity coupling means. Since this is a dual-mode filter, each cavity is capable of supporting two independent resonant modes. Therefore, the number of physical cavities 11, 12, . . . 1N is equal to half the number of electrical cavities. Intra-cavity coupling between the two orthogonal modes within a given cavity is achieved by means of a physical discontinuity which perturbs the electric field of one mode to couple energy into a second mode. The physical discontinuity shown in FIG. 1 is represented by a series of coupling screws 21, 22, . . . 2N. Said coupling screws are shown as being mounted at a 45 degree angle relative to tuning screws 41, 42, 43, 44, . . . 4(2N-1), 4(2N), but this particular angle can be varied. The relative positions of the coupling screws in each cavity has an effect on the sign of any feedback coupling between non-sequential modes and thus affects the type of filter function that can be realized. The tuning screws perturb the electric field of each orthogonal mode independently and decrease the cutoff wavelength of the wave-guide in the plane of each screw. Thus, the cavity length for each mode appears electrically longer than its physical length.

Each iris 51, 31, 32, . . . 5N contains an aperture 52, 36, 37, . . . 7N respectively. Inter-cavity coupling is influenced by magnetic field energy transfer through the apertures 36, 37 in the irises 31, 32 in the conductive end walls of each cavity located between adjacent cavities. The apertures are not confined to any particular shape as long as the polarizability of each aperture can be independently controlled about two perpendicular axes. Preferably, the apertures 36, 37 have a cruciform shape (as shown) that is aligned with the axis of the tuning screws 41, 42, 43, 44. The input and output apertures 52, 7N respectively need a polarizability about one axis only because energy must be coupled only into the first, or out of the last mode. Thus, the long thin slots forming apertures 52, 7N are sufficient to achieve the necessary polarizability for the input and output. Various other configurations could be used for apertures which provide polarizability along a single axis. These will be readily apparent to those skilled in the art.

An Atia and Williams filter 9 shown in FIG. 2 and a Pfitzenmaier filter 10 shown in FIG. 3 follow the same basic operating principles as the Blachier and Champeau filter 8 shown in FIG. 1. The main difference between the three filters is that the Atia and Williams and Pfitzenmaier filters 9, 10, allow for coupling between the input and output modes. This permits the realization of a more generalized symmetrical filter response than can be achieved with the Blachier and Champeau filter 8 shown in FIG. 1. The main difference between the Atia and Williams filter 9 and the Pfitzenmaier filter 10 is that the Atia and Williams filter 9 is physically symmetrical about a longitudinal axis. On the other hand, the Pfitzenmaier filter 10 is physically asymmetrical. The Atia and Williams filter 9 and the Pfitzenmaier filter 10 have the same electrical performance potential.

The same numerals are used in FIGS. 2 and 3 to describe the parts that are identical to those shown in FIG. 1. The physical difference between the Atia and Williams filter 9 of FIG. 2 and the Blachier and Champeau filter 8 of FIG. 1 is the fact that the output port 62 in the filter 9 is located in the same end plate 61 as the input port 62. An end plate 6N of cavity N of filter 9 does not contain any aperture. The main difference between the Pfitzenmaier filter 10 as shown in FIG. 3 and the Blachier and Champeau filter 8 as shown in FIG. 1 is that an end plate 6N of cavity N of filter 10 does not contain any output port or aperture. Instead, an output port 71 is located in a sidewall of cavity 12 adjacent to cavity 11. This completes our discussion of the prior art filters shown in FIGS. 1, 2 and 3.

We shall now discuss various embodiments of the present invention in greater detail. Again, the same numerals are shown in FIGS. 4 to 7 to identify parts that are identical to the parts shown in FIG. 1.

Figure 4:
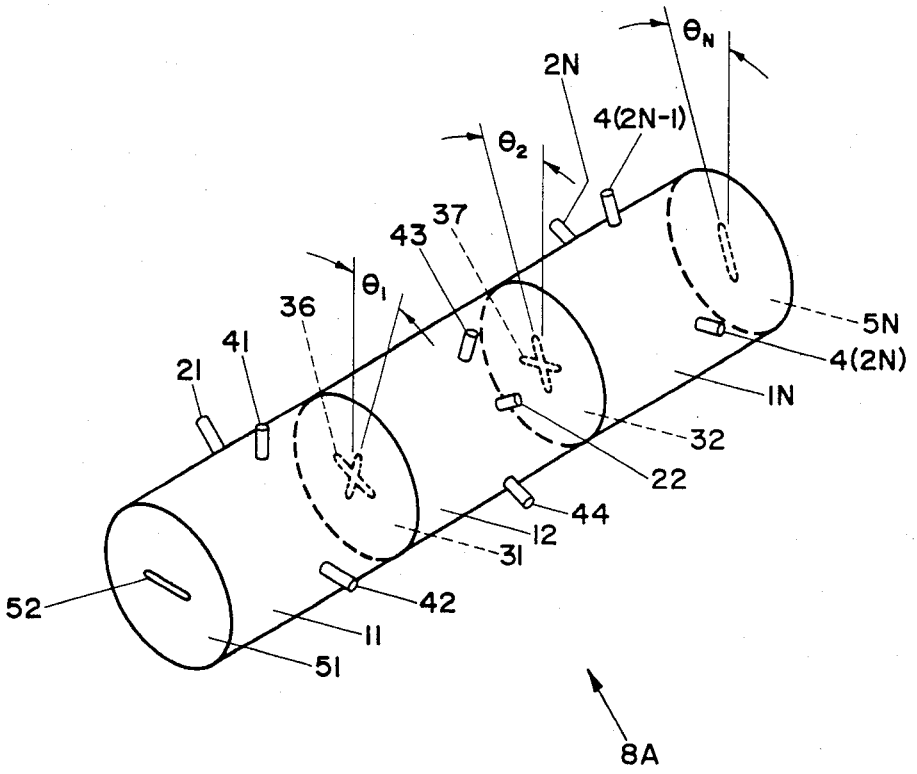
FIG. 4 is a perspective view of a cylindrical Blachier and Champeau filter modified, according to the present invention, to utilize quasi-orthogonal coupling structures.

In FIG. 4, the Blachier and Champeau filter 8 of FIG. 1 is modified in accordance with the present invention. The end plate 51 has an aperture 52 in the form of a slot which represents the input port to modified filter 8A. The angle of the aperture 52 establishes the input reference mode through the filter 8A. The cavity 12 is rotated about the longitudinal axis of the filter 8A by an angle $\theta_1$. Cavity 1N is rotated about the longitudinal axis of the filter 8A relative to the input reference mode 51 by an angle $\theta_2$. For purposes of illustration only, angle $\theta_1$ is shown as a positive (clockwise) angle and angle $\theta_2$ is shown as a negative (counter-clockwise) angle. However, each of the angles $\theta_1$, $\theta_2$ . . . $\theta_N$ can either be positive or negative depending on the response required. The rotation of the cavity 12 relative to the input reference mode 51 causes the magnetic fields in cavity 12 to be angularly offset from those in cavity 11. The offset fields in cavity 12 can be resolved into orthogonal components with reference to the first and second modes contained in cavity 11. The result of resolving the modes in the cavity 12 with respect to the modes in the cavity 11 is the introduction of two new couplings which did not previously exist in said filter 8A. These two new couplings are referred to as quasi-orthogonal couplings as they are offset from the orthogonal couplings already present in the filter 8A before it is modified in accordance with the present invention. These quasi-orthogonal couplings, which are interrelated, provide the basis for achieving symmetrical or asymmetrical control of the filter response. In order to achieve a desired result, it may be necessary to change other couplings and cause the modes in the filter to resonate at different frequencies. These variations will depend on the desired response and will be readily apparent to those skilled in the art. The narrow-band multi-coupled cavity synthesis referred to above and developed by Atia, Williams and Newcomb does not apply to a filter that has been modified in accordance with the present invention.

Figure 5:
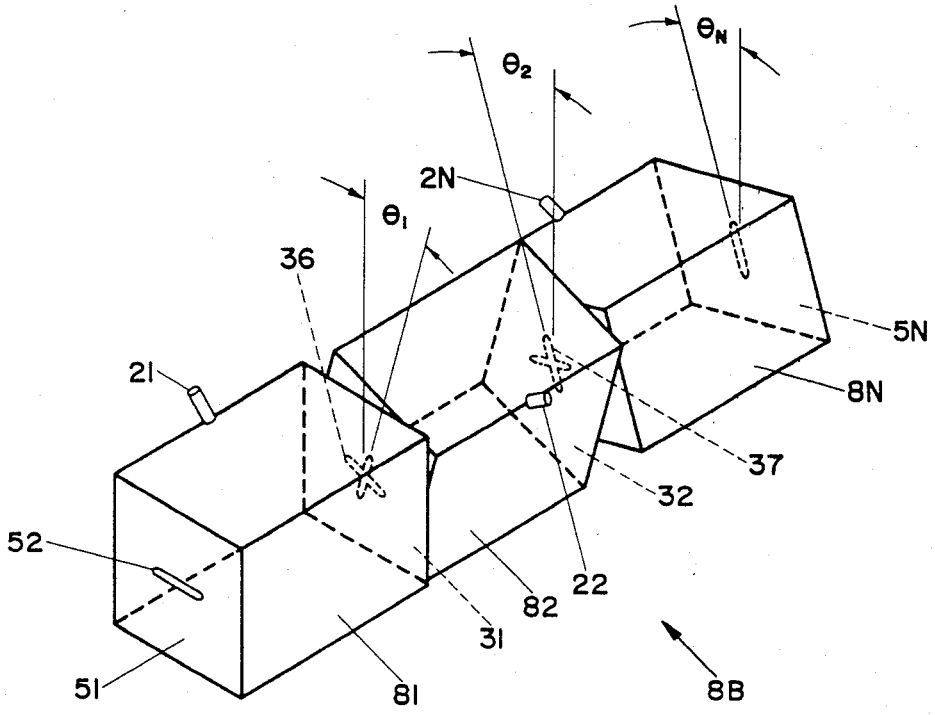
FIG. 5 is a perspective view of a cuboid Blachier and Champeau filter modified, according to the present invention, to utilize quasi-orthogonal coupling structures.

FIG. 5 shows a cuboid Blachier and Champeau filter 8B that has been modified in accordance with the present invention. Cavity 82 has been rotated along the longitudinal axis of the filter 8B by an angle $\theta_1$, relative to the input reference mode 51. Cavity 1N has been rotated along the longitudinal axis of the filter 80 by an angle $\theta_2$. Again, angle $\theta_1$ and angle $\theta_2$ can each be either positive or negative depending on the filter response requirement. The filter operates in the same manner as the filter 8*a* shown in FIG. 4 in that quasi-orthogonal couplings are introduced into the filter 8B. These couplings are called quasi-orthogonal couplings as they are offset from the orthogonal couplings already present in the filter 8B before it is modified in accordance with the present invention.

Figure 6:
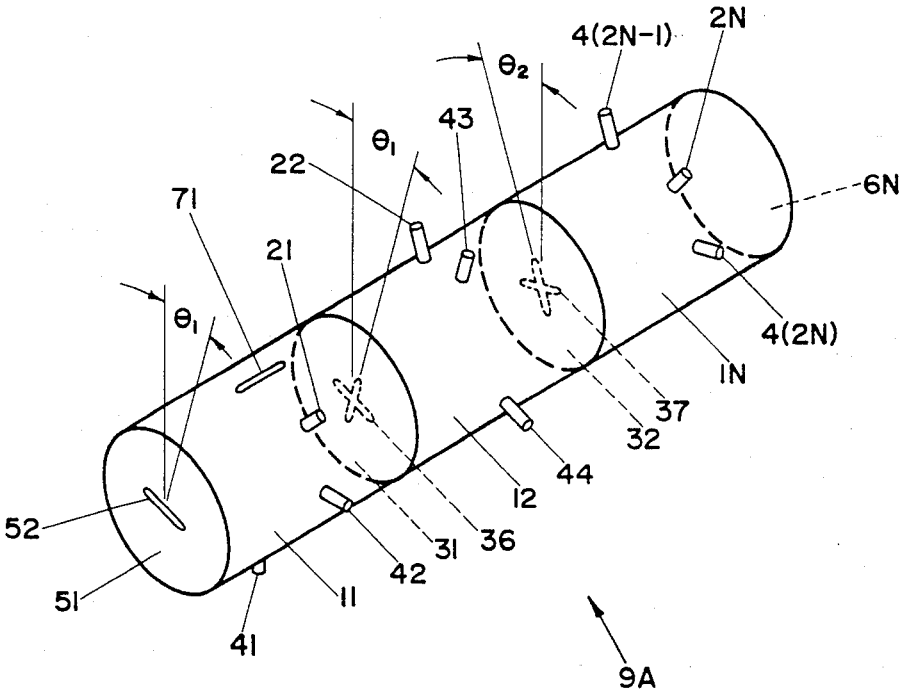
FIG. 6 is a perspective view of a cylindrical filter of Atia and Williams modified, according to the present invention, to utilize quasi-orthogonal coupling structures.

In FIG. 6, there is shown an Atia and Williams filter 9A that has been modified in accordance with the present invention. Cavity 12 has been rotated by an angle $\theta_1$ about the longitudinal axis of the filter 9A relative to cavity 11. Output port 71 has also been rotated about the longitudinal axis of the filter 9A by the same angle $\theta_1$. Cavity 1N has been rotated about the longitudinal axis of the filter 9A relative to the input reference mode 51 by an angle $\theta_2$, where angle $\theta_1$ and angle $\theta_2$ can each be either positive or negative depending on filter response requirement.

Figure 7:
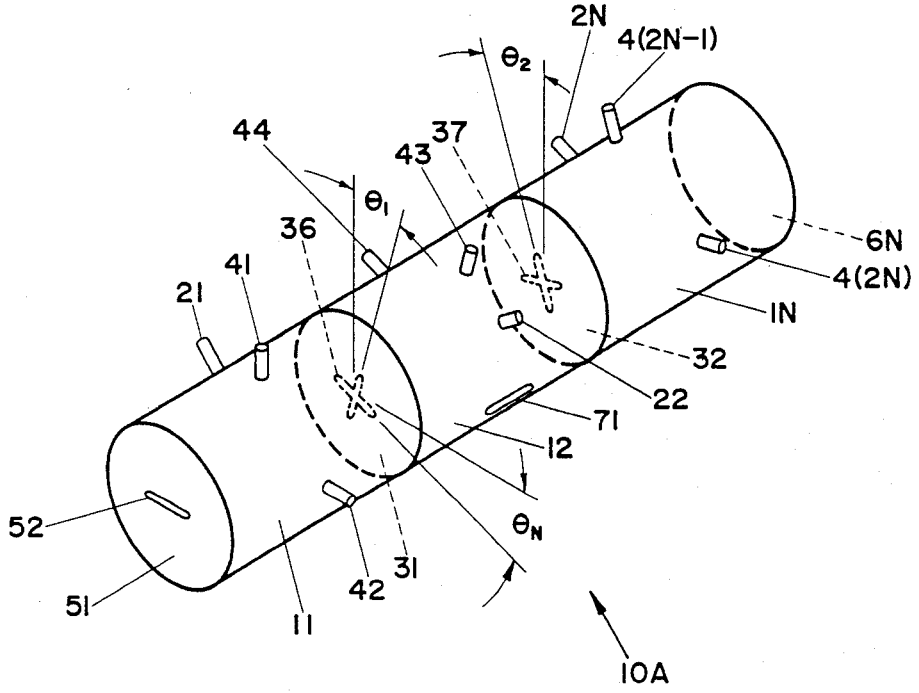
FIG. 7 is a perspective view of a cylindrical Pfitzenmaier filter modified, according to the present invention, to utilize quasi-orthogonal coupling structures.

In FIG. 7, there is shown a Pfitzenmaier filter 10A which has been modified in accordance with the present invention. The cavity 12 including the output port 71 has been rotated about the longitudinal axis of the filter 10A by an angle $\theta_1$. The cavity 1N has been rotated about the longitudinal axis by an angle $\theta_2$ relative to the reference mode 51, where angle $\theta_1$ can be either positive or negative depending on filter response requirement. As with the modified Blachier and Champeau filter 8*a* described in FIG. 4, the rotation of the cavities 12 and 1N relative to the reference mode 51 of filter 8A causes quasi-orthogonal couplings to be introduced into the cavities. Also, whether the filter provides a symmetrical or asymmetrical response can be controlled by the rotation of the cavities.

To achieve the results shown in FIGS. 8 to 11, four bandpass filters were built. Two of them were constructed in accordance with the prior art; two of them were constructed in accordance with the present invention.

Figure 8A:
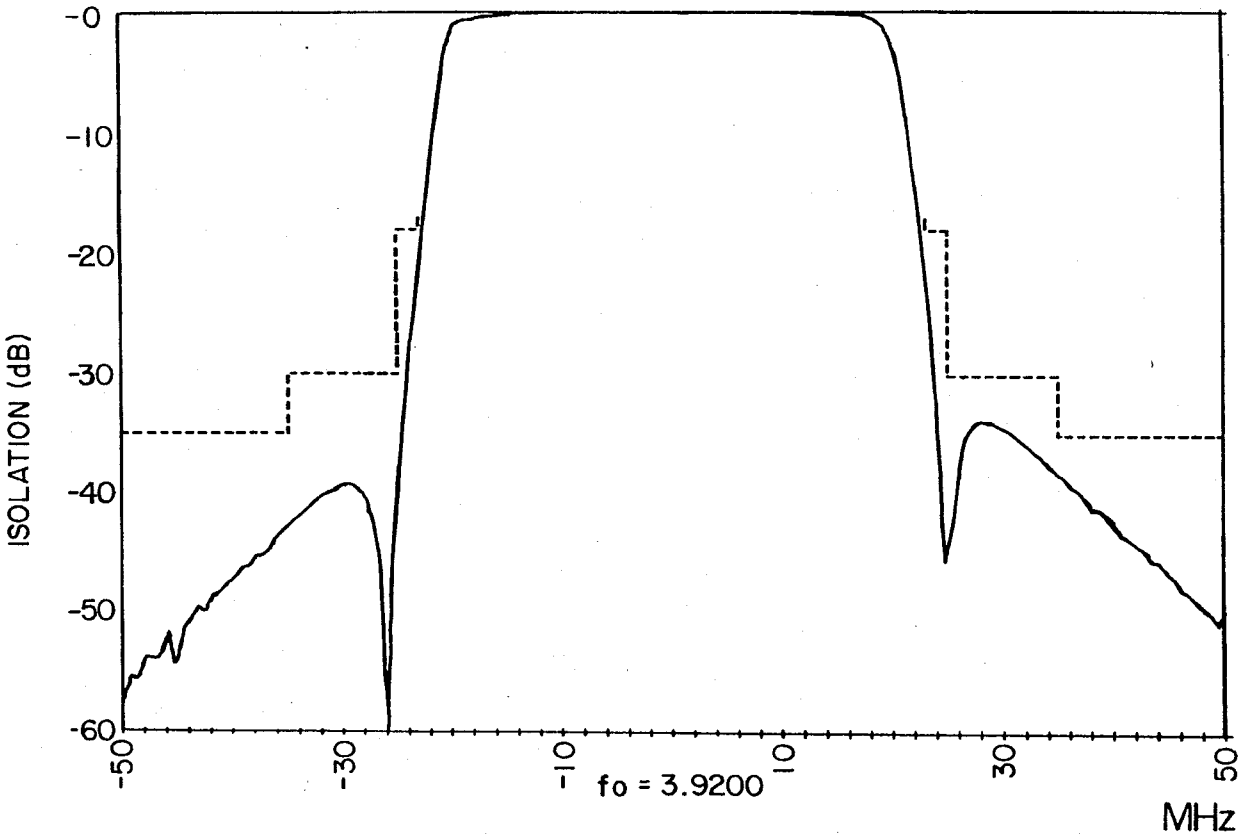
FIGS. 8A and 8B are graphs showing experimental response characteristics of a Blachier and Champeau 8 pole, dual-mode, non-minimum phase filter.
Figure 9A:
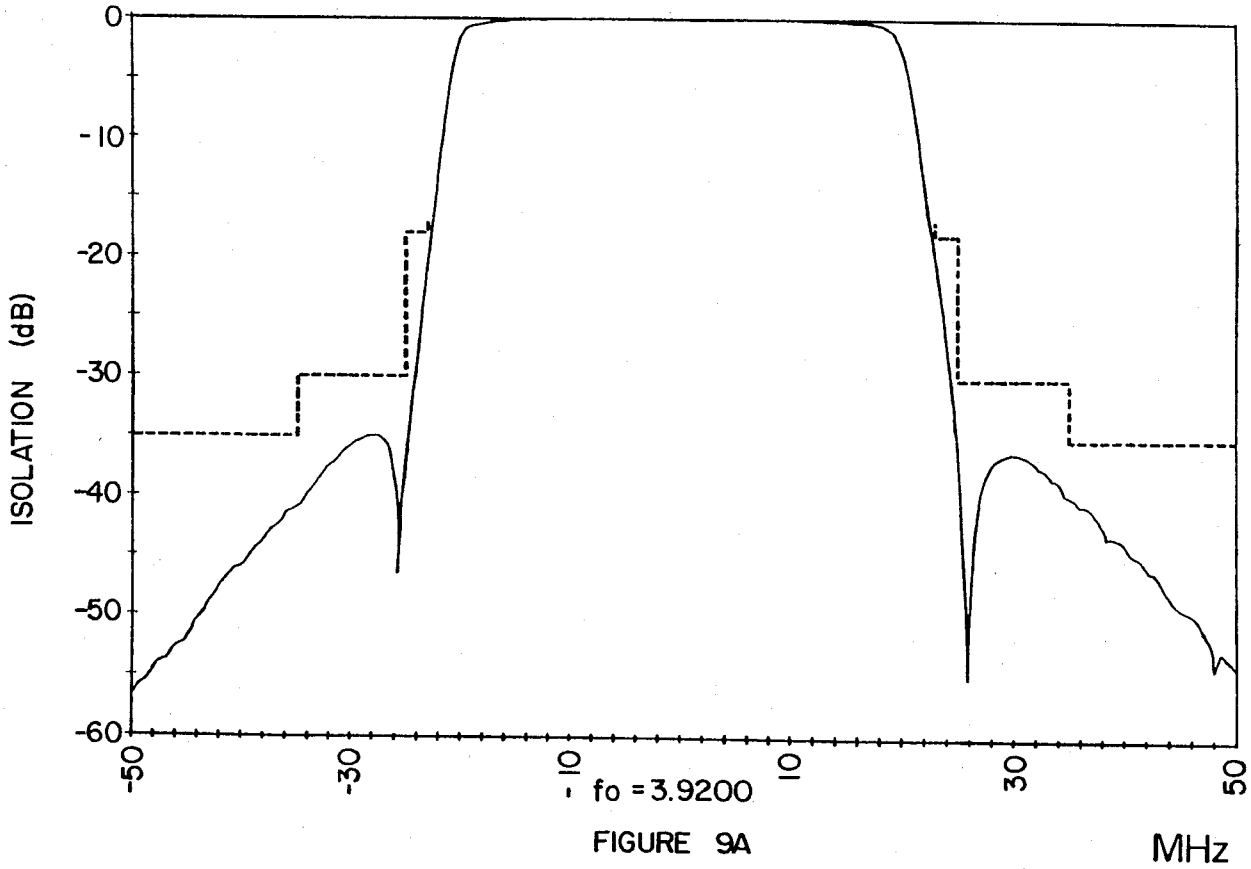
FIGS. 9A and 9B are graphs showing experimental response characteristics of a Blachier and Champeau 8 pole, dual-mode, non-minimum phase filter modified in accordance with the present invention.

FIG. 8A shows the amplitude response measured from a Blachier and Champeau type eight pole longitudinal, dual-mode, wave-guide filter. A typical specification is shown by the dotted lines. FIG. 9A shows the measured amplitude response for the same Blachier and Champeau type filter after it has been modified in accordance with the present invention with $\theta_1=\theta_2=\theta_3=\theta_4=4°$. In other words, cavities 2, 3, 4 and 5 are each rotated in the same direction and by the same amount relative to the input reference mode. Again, the given specification is shown by the dotted lines. As can readily be seen, the responses in each of FIGS. 8A and 9A pass the given specification without any appreciable difference.

Figure 8B:
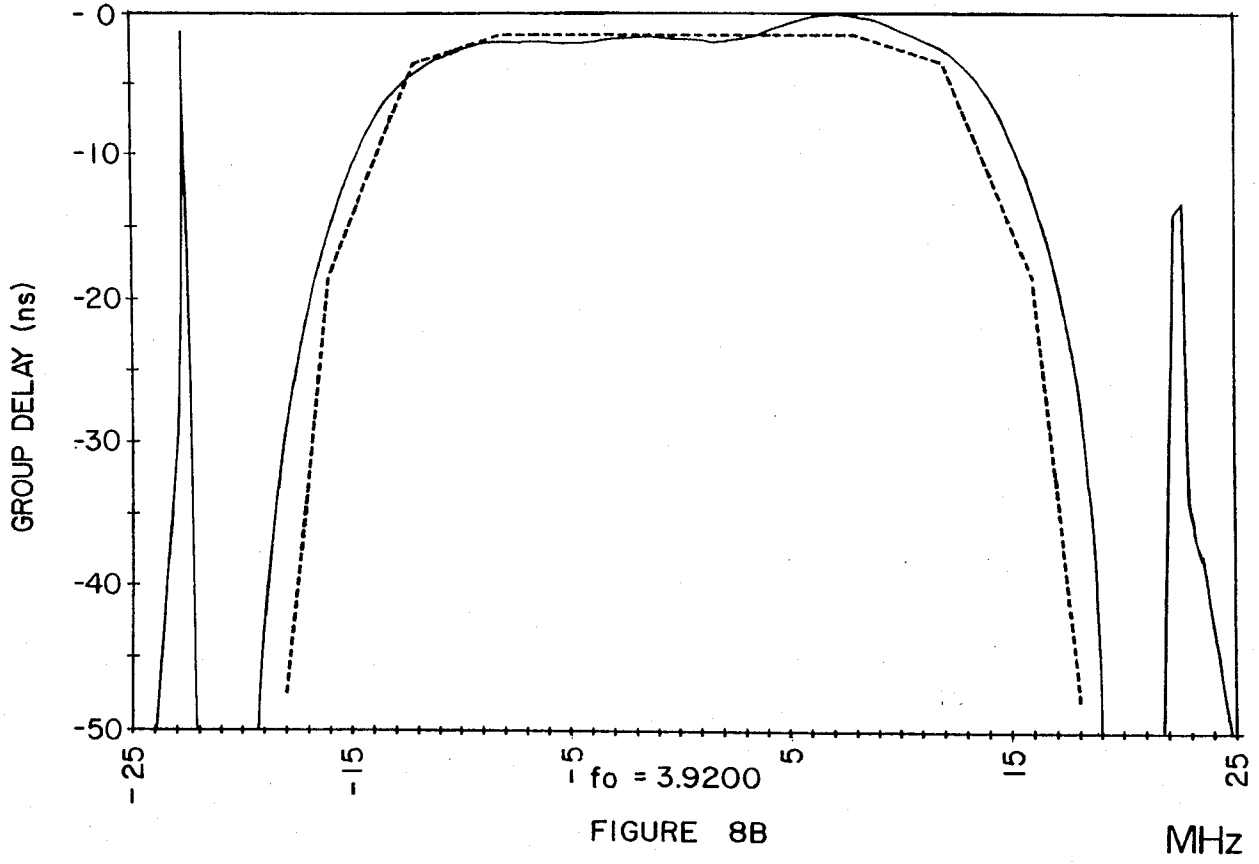
Figure 9B:
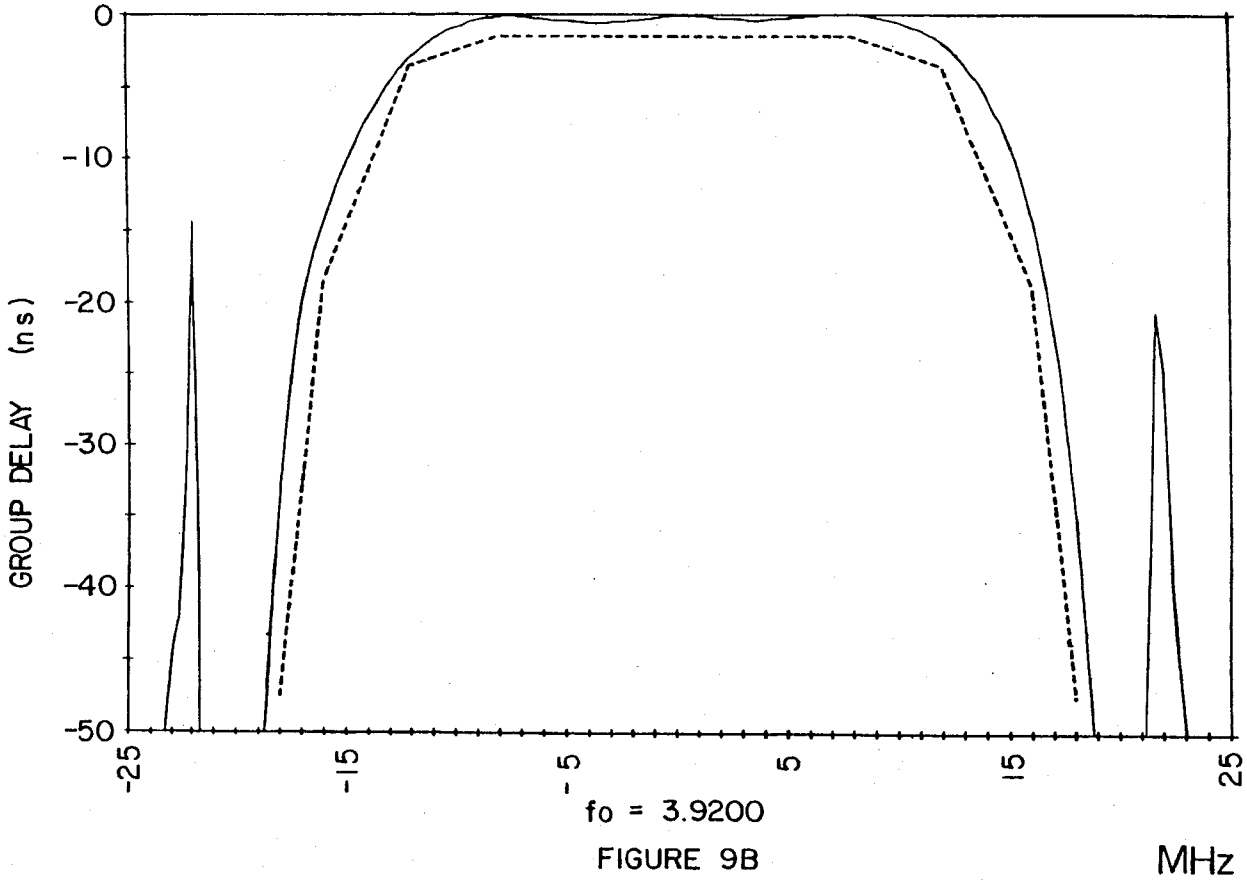

FIG. 8B shows a group delay response of the same Blachier and Champeau type filter used to obtain the results in FIG. 8A together with a typical specification shown by the dotted line. It can readily be seen that the group delay of the Blachier and Champeau filter recorded in FIG. 8B has a slope across the passband and violates the given specification. This slope is caused by wave-guide dispersion and cannot be corrected with the conventional Blachier and Champeau type filter configuration. However, FIG. 9B shows the group delay response of the same modified Blachier and Champeau filter 8 used to obtain the result in FIG. 8B. It can be seen that the slope of the group delay no longer crosses the passband of the filter response and becomes perfectly symmetrical. Thus, the rotation of the cavities by 4° relative to the input mode enables the group delay response of the filter to be adjusted to eliminate the slope across the passband.

Figure 10:
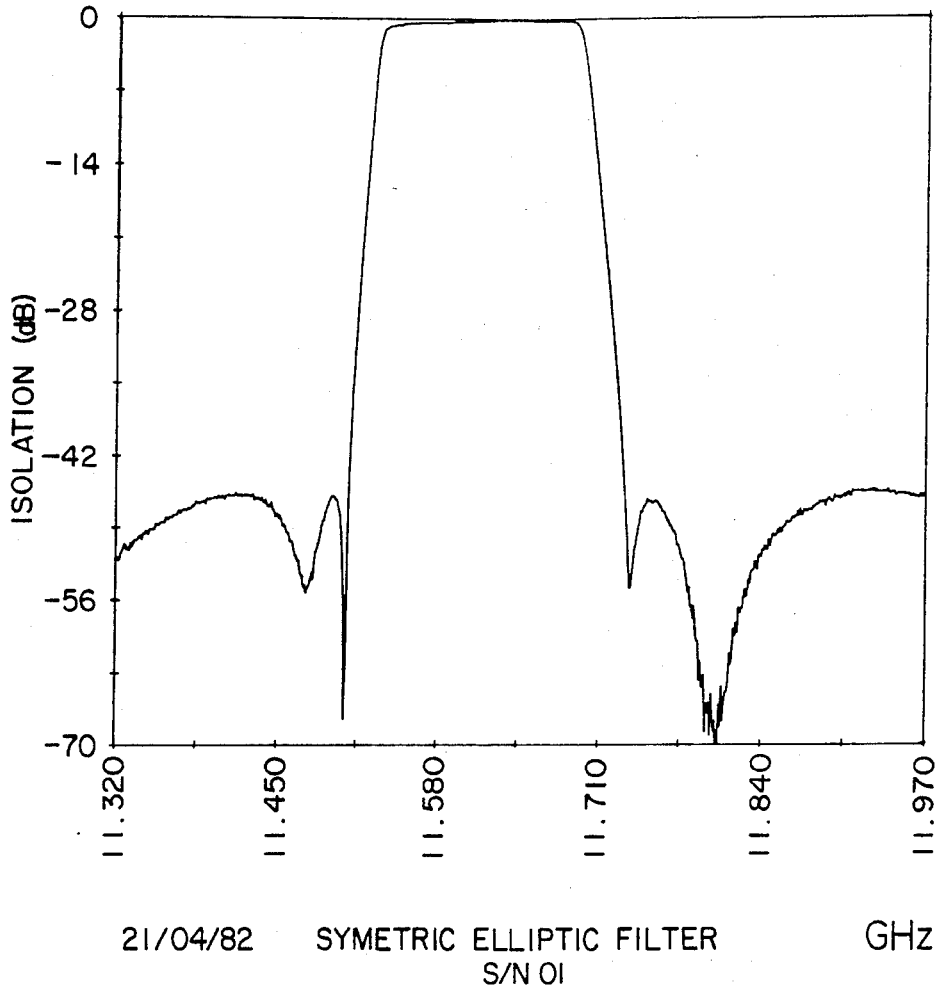
FIG. 10 is a graph showing the experimental response characteristics of a Pfitzenmaier 6 pole, dual-mode, minimum phase filter; and, FIG. 11 is a graph showing the experimental response characteristics of a Pfitzenmaier 6 pole, dual-mode, minimum phase filter modified in accordance with the present invention.
Figure 11:
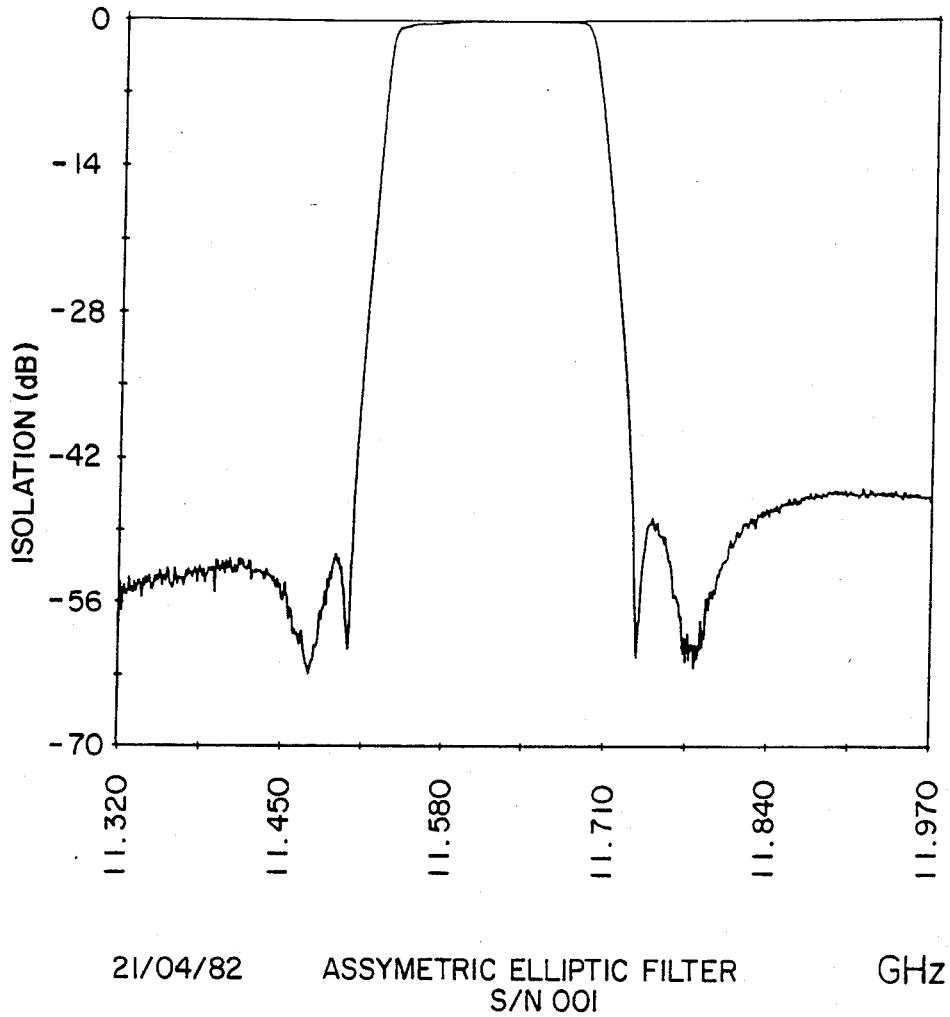

In FIGS. 10 and 11, it is shown that the present invention can be used to produce an asymmetrical filter response from a filter that would otherwise produce a symmetrical filter response. In FIG. 10, there is shown the measured amplitude response of a prototype six pole Pfitzenmaier filter 10. It can readily be seen that the response shown in FIG. 10 is symmetrical. In FIG. 11, there is shown a measured response of the same Pfitzenmaier type filter modified in accordance with the present invention with $\theta_1=6°$, $\theta_2=0°$ and $\theta_3=6°$. This means that the second and fourth cavities are rotated in the same direction by 6° relative to the input reference mode and that the third cavity is not rotated at all. It can readily be seen from FIG. 12 that the response is now asymmetrical.

What we claim as our invention is:

1. A bandpass filter comprising a plurality of cascaded wave-guide cavities with inter-cavity coupling means, said filter having an input reference mode, at least one of said cavities being rotated with respect to said reference mode, thereby causing quasi-orthogonal coupling structures to be introduced into said cavities, each cavity having a length equal to n times the half-guide wave length at a centre frequency of the filter, where n is an integer and corresponds to the third mode index of a TE mode micro-wave to be transmitted.

2. A filter as claimed in claim 1 wherein said filter is a dual-mode filter.

3. A filter as claimed in claim 2 wherein all cavities of said filter have the same cross-sectional area.

4. A filter as claimed in claim 3 wherein all of said cavities are cuboid.

5. A filter as claimed in claim 3 wherein all of said cavities are cylindrical.

6. A filter as claimed in claim 3 wherein at least one of said cavities is cuboid and the remaining cavities are cylindrical.

7. A filter as claimed in claim 3 wherein at least one of said cavities is cylindrical and the remaining cavities are cuboid.

8. A filter as claimed in claim 1 wherein the filter is of the order N, N being an even integer, and the number of cavities is equal to N/2.

9. A filter as claimed in claim 1 wherein said filter is of the order N, N being an odd integer, and the number of cavities is equal to $(N-1)/2$ cavities operating in a dual-mode plus one single mode cavity.

10. A filter as claimed in claim 1 wherein there is an additional cavity having a rectangular cross-section mounted in cascade with the other cavities.

11. A filter as claimed in claim 2 wherein said cavities resonate at the same frequency, said frequency being the centre frequency of the bandpass filter.

12. A filter as claimed in claim 2 wherein said cavities resonate at various frequencies to realize a prescribed response shape.

* * * * *